US005179928A

United States Patent [19]

Cour et al.

[11] Patent Number: 5,179,928

[45] Date of Patent: Jan. 19, 1993

[54] INTERNAL COMBUSTION ENGINE IGNITION DEVICE

[75] Inventors: Marie M. H. Cour, Portet-sur-Garonne; Raymond F. J. Vernieres, Villefranche-de-Lauragais, both of France

[73] Assignee: Siemens Aktiengesellschaft, Munich, Fed. Rep. of Germany

[21] Appl. No.: 809,483

[22] PCT Filed: Jun. 25, 1990

[86] PCT No.: PCT/EP90/01013

§ 371 Date: Feb. 24, 1992

§ 102(e) Date: Feb. 24, 1992

[87] PCT Pub. No.: WO91/00961

PCT Pub. Date: Jan. 24, 1991

[30] Foreign Application Priority Data

Jul. 13, 1989 [FR] France ..... 89/09489

[51] Int. Cl.[5] ..... F02P 3/06

[52] U.S. Cl. ..... 123/606; 123/598; 123/620

[58] Field of Search ..... 123/606, 607, 604, 620, 123/621, 622, 637, 644, 596, 598; 315/209 T

[56] References Cited

U.S. PATENT DOCUMENTS

| | | | |
|---|---|---|---|
| 2,376,189 | 5/1945 | Robinson et al. | 123/606 |
| 3,758,821 | 9/1973 | Canup | 123/606 |
| 4,258,296 | 3/1981 | Gerry | 123/606 |
| 4,291,661 | 9/1981 | Gerry | 123/606 |
| 4,417,563 | 11/1983 | Brodic | 123/606 |
| 4,674,467 | 6/1987 | Tokura et al. | 123/644 |
| 4,915,087 | 4/1990 | Boyer | 123/620 |
| 4,932,387 | 6/1990 | Flam et al. | 123/607 |
| 4,998,526 | 3/1991 | Gokhale | 123/598 |
| 5,009,213 | 4/1991 | DiNunzio et al. | 123/620 |
| 5,056,496 | 10/1991 | Morino et al. | 123/604 |
| 5,097,815 | 3/1992 | Oota et al. | 123/606 |
| 5,113,839 | 5/1992 | Hartmann et al. | 123/606 |

FOREIGN PATENT DOCUMENTS

| | | | |
|---|---|---|---|
| 0181961 | 5/1986 | European Pat. Off. | 123/606 |
| 2543125 | 4/1977 | Fed. Rep. of Germany | 123/606 |
| 2401328 | 3/1979 | France | 123/606 |

*Primary Examiner*—Raymond A. Nelli

*Attorney, Agent, or Firm*—Herbert L. Lerner; Laurence A. Greenberg

[57] ABSTRACT

The device comprises an a.c. voltage source (5, 6, 7), a resonant circuit (Lf, Cs) coupled to a transformer (9) and a plug (10) which is supplied under high tension by the resonant circuit. An oscillator (11) controls the frequency of the voltage source. Means (14) are provided for detecting the resonant frequency of the circuit (Lf, Cs) and for tuning the oscillator to this frequency during priming. The device further comprises means (13) for adjusting the frequency of the oscillator, after the priming, to a value ensuring the sustaining of the arc and means (15) for cutting this arc after the elapse of a predetermined period.

12 Claims, 1 Drawing Sheet

Figure 1:
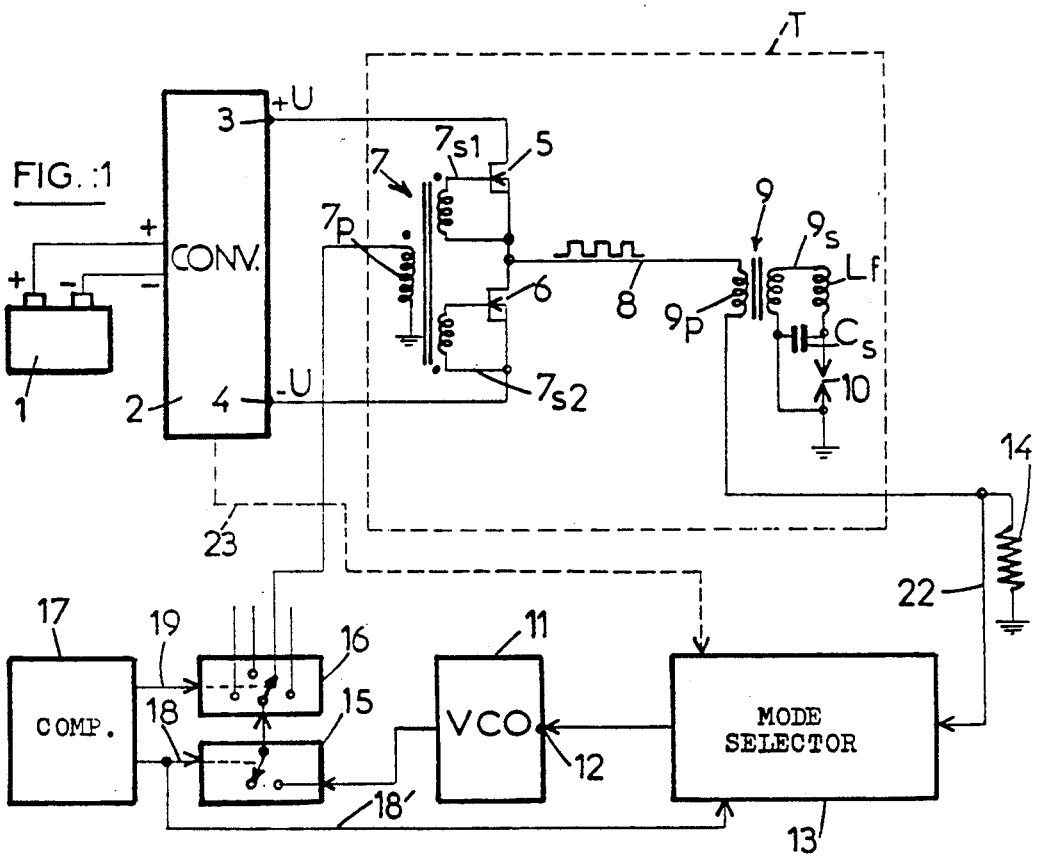

T
CONV.
+U
-U
3
4
2
1
7
7s1
7s2
7p
5
6
8
9
9s
9p
Lf
Cs
10
14
22
23
17
COMP.
19
18
18'
16
15
11
VCO
12
MODE SELECTOR
13

UB
UBo
0
to
t

VOLTAGE

Fo
F

POWER

Pe
Fo
Fe
F

INTERNAL COMBUSTION ENGINE IGNITION DEVICE

The present invention relates to an ignition device for an internal combustion engine intended, more particularly but not exclusively, for the propulsion of a motor vehicle.

Conventionally such a device comprises a high voltage generator and several spark plugs each placed in one of the cylinders of the engine.

A distributor cyclically ensures the connection of each plug with the generator at predetermined instants of the cycle of the engine, reference relative to the top dead centre of each piston in the associated cylinder, so that the high voltage transmitted to the plug by electrical cables causes the formation of a spark between the electrodes of the plug, which spark causes the ignition of the air-fuel mixture compressed by the piston in the cylinder.

This device, used universally, has however shown some weaknesses. The first has to do with the mechanical nature of the distributor. Firstly, it is subjected to wear from a center rubbing electrical contact. There is also the risk of electrical arc breakdown in the distributor region rather than that of the plug. There is furthermore degradation of the electrical contacts due to the spark between a rotor arm and the contacts. Moreover, with such a mechanical distributor the range of possible variations of the ignition advance is limited. Finally, the distributor being mounted on a rotating shaft driven by the motor, this arrangement involves an add-on cost due to these additional parts.

A second weakness has to do with the presence and the length of the cables which transmit the high voltage between the distributor and each plug. The passage of this high voltage in these cables can, through leakages, be dangerous for a person inspecting the motor and who happens to touch a defective cable. This high voltage can also create electromagnetic interference, particularly damaging in modern vehicles which include more and more sensors, electronic boxes, actuators, interconnected through electrical wires, whose operation can be disturbed by this interference.

In order to escape from these disadvantages, it has been conceived to eliminate the distributor, a solution which implies that, for each plug, there is an associated high voltage generator which is individual to it. The generator is then mounted directly on the plug, which clearly eliminates the high-voltage cables and the electrical and electromagnetic problems which are associated with them.

The problem then comes down to designing a high voltage generator sufficiently compact to be able to be mounted directly on a plug.

If an ignition of the inductive type is chosen, the energy necessary for the ignition is stored in the magnetic circuit of a transformer which constitutes, at the moment of the discharge of this energy, the high voltage generator. The volume of this magnetic circuit is substantially proportional to the energy which must be stored. Taking into account the large quantity of energy to be supplied to the plug in order to obtain the ignition of the air-fuel mixture, it has been found that it was not possible to reduce the dimensions of the transformer sufficiently to enable it to be comfortably installed on the plug.

If an ignition of the capacitive type is chosen in which the ignition energy is stored in a capacitor then discharged on the plug with the help of a transformer, it is possible to greatly reduce the dimensions of this transformer since the latter no longer has to store the ignition energy. However, it is known that ignitions of the capacitive type give short duration sparks which have the disadvantage of providing an unstable ignition of the air-fuel mixture, above all at low speed. From FR-A-2, 090, 101 is known an internal combustion engine ignition device which creates ignition sparks by amplification at resonance of an oscillator signal generated by a fixed Jensen oscillator whereby the current is reduced by a shift in frequency caused by a gap in transformer magnetic core once a spark has been created.

The object of the present invention is to construct an ignition device designed to enable the elimination of the distributor and the associated high voltage electrical cables whilst allowing the use of transformers with reduced spatial requirements individually mounted on each plug.

The object of the present invention is also to construct such a device allowing the production of ignition sparks which are adjustable in duration and in current intensity.

The object of the present invention is further to construct such a device comprising means for repriming the sparking arc in the event of rupture of this arc.

These objects of the invention, as well as others which will emerge in the remainder of the present description, are achieved with an internal combustion engine ignition device of the type comprising a plug (10) and a high voltage generator which selectively supplies the plug in order to trigger the formation of an air-fuel mixture ignition arc, comprising an AC voltage source, the AC voltage source comprising two electronic switches (5, 6) placed in series between lines to direct voltages +U and −U respectively, these switches being controlled by first and second secondary circuits ($7_{s1}$, $7_{s2}$) in phase opposition, respectively, of a first transformer (7), the high voltage generator comprising a resonant circuit (Lf, Cs) supplied by the AC voltage source at the resonant frequency (Fo) of the circuit in order to ensure the supplying of the plug (10) with a resonance amplified voltage, suitable to cause the formation of an air-fuel mixture electrical ignition arc between electrodes of the plug (10), the high voltage generator further comprising a second transformer (9) interposed between the AC voltage source and the plug (10), the resonant circuit (Lf, Cs) being established between this second transformer (9) and the plug (10) via a series inductance (Lf) in the secondary circuit (9s) of the second transformer (9), and a parallel capacitance (Cs) on the plug, the ignition device comprising measuring means (14) designed to detect the current in the primary winding (9p) of the second transformer (9) and the ignition device comprising further an oscillator (11) for supplying the primary winding (7p) of the first transformer (7) the frequency of said oscillator (11) being driven according to the detected current in the primary winding (9p) of the second transformer (9).

The device further comprises a mode selector which determines the control mode of the oscillator. For the generation of an arc or spark, three control modes occur in succession:

1) search for the resonant frequency, by forcing the output of the oscillator to a stable electrical voltage level (application of a voltage step), 2) driving of the oscillator to the resonant frequency Fo during the priming of the arc (the modes 1 and 2 can be inseparable and correspond to an arc priming phase), 3) driving of the oscillator to a frequency Fe which can be different from Fo and which depends on the value of the power which it is desired to deliver during an arc sustaining phase.

The device further comprises means for measuring the response of the resonant circuit and ensuring the operation in the various modes:

the mode selector is sensitive to the amplitude and/or to the phase of the primary current of the transformer to accurately establish the value of the resonant frequency Fo of the resonant circuit, the mode selector is moreover sensitive to the priming of the arc in the plug to then establish a sustaining strategy for the arc as indicated above.

By virtue of the use, in the device according to the invention, of a resonant circuit to ensure the amplification, up to the priming of an arc between the electrodes of the plug, of the voltage delivered by the a.c. voltage source, it is possible to use a transformer with a transformation ratio lower than those of the transformers used in the conventional inductive or capacitive ignition devices. As a result, the intensity of the primary current used, proportional to this transformation ratio, is lower and it is then possible, as will be seen further below, to use high-speed electronic switches to obtain an AC voltage source from a DC voltage source such as a motor vehicle battery, followed by a DC converter.

By virtue of these switches a direct transfer of energy between the source and the plug can be ensured without intermediate storage in the transformer. This latter, no longer having to retain a large quantity of energy in its magnetic circuit, can then have reduced dimensions facilitating its direct mounting onto an associated plug. By associating such a transformer with each of the plugs of an internal combustion engine there is no longer a need to have recourse to a distributor. Furthermore, the cables necessary for the transmission of a high voltage are eliminated. As was seen earlier, these two arrangements allow elimination of a number of disadvantages of the ignition devices of the prior art.

Figure 2:
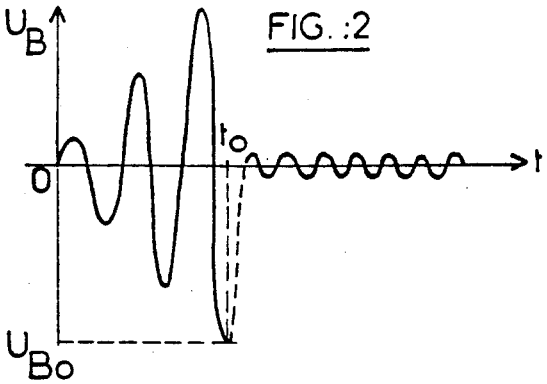
Figure 4:
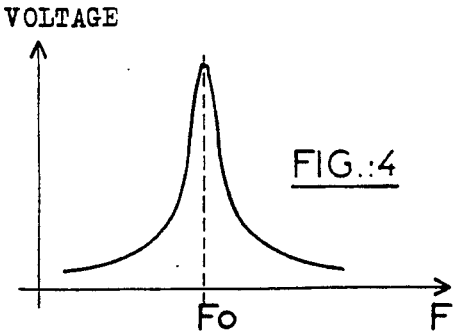
Figure 3:
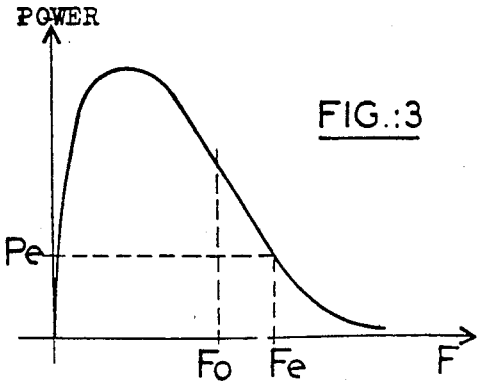

Other characteristics and advantages of the present invention will emerge on reading the description which follows with reference to the attached drawing in which:

FIG. 1 is a circuit diagram illustrating the organization of the ignition device according to the invention, FIG. 2 illustrates the waveform of the supply voltage of a plug forming part of the device according to the invention, during priming of an arc then during sustaining of this arc, and FIGS. 3 and 4 are graphs useful in the description of the operation of the device according to the invention during sustaining and priming respectively of the arc.

Referring to FIG. 1 of the attached drawing where it is seen that the ignition device according to the invention is supplied by a battery 1 of a motor vehicle, which is propelled by an internal combustion engine. Of course an illustrative and nonlimiting application of the present invention is considered there.

The battery 1 delivers a relatively low level DC voltage, for example +12 V. In the device according to the invention, this battery voltage supplies a DC—DC converter 2, of a conventional type, which provides, at its outputs 3 and 4, DC voltages +U and −U respectively, amplified relative to the supply voltage to obtain, for example, +200 V and −200 V respectively.

As was seen earlier the invention makes use of a voltage amplification by a resonant circuit which thus demands a supply by an AC voltage source of frequency adjusted to the resonant frequency of the circuit.

According to the invention such a voltage source is provided by associating, with the converter 2 and with the battery 1, a switching stage constituted by two electronic switches 5, 6, MOS power transistors for example, whose drain-to-source paths are placed in series between the outputs 3 and 4 of the converter 2. The gates of the transistors 5 and 6 are controlled by two secondary windings, distinct and wound in phase opposition, $7_{s1}$ and $7_{s2}$, of a small control transformer 7 also comprising a primary windings $7_P$.

By supplying the primary circuit $7_P$ with a matched AC control voltage it is understood that the voltage of the line 8 connected to the point common to the transistors 5 and 6 is brought either to the voltage +U or to the voltage −U since at any instant the primary circuit orders the blocking of one of the transistors and the conduction of the other, and vice versa. Thus, an AC voltage of square waveform and of frequency equal to that of the supply voltage of the primary circuit $7_P$ of the transformer 7 is obtained on the line 8.

According to the invention this voltage serves to supply the primary circuit $9_P$ of a second transformer 9 whose secondary $9_s$ supplies a spark plug 10 placed in a cylinder (not shown) of an internal combustion engine capable of being filled with an air-fuel mixture which the plug serves to ignite. In this regard, it is understood that as such an engine is able to comprise several cylinders, 2, 4 or 6 for example, the portion of the device according to the invention which is surrounded by a broken line T in FIG. 1 must be duplicated as many times as there are cylinders in the engine equipped with the ignition device according to the invention. The distribution, that is to say the switching of the device according to the invention from one plug of a cylinder to that of another cylinder, intervenes in the absence of supply of the primary circuit $7_P$, the two transistors 5 and 6 then being blocked and the line 8 thus brought to a floating potential which renders the transformer 9 inactive.

According to an important characteristic of the device according to the invention, the latter comprises means for tuning the frequency of the AC supply voltage of the primary circuit $9_P$ of the transformer 9 to the resonant frequency of a circuit (Lf, Cs) connected, at the secondary of the transformer 9, with the plug 10, to supply the latter with a high voltage created in this resonant circuit. These means are brought into play, during priming of the arc, by virtue of a voltage controlled oscillator 11 (VCO) via an input 12 through a mode selector 13, the functions of which will be described in detail further below.

According to the present invention this mode selector selectively controls the execution of a first or of a second control strategy for the oscillator, corresponding respectively to the priming phase of the arc in the plug and to a subsequent phase of maintenance or sustaining of the arc current. In the priming phase the first strategy orders the supply of the circuit (Lf, Cs) at its resonant frequency so that this circuit very rapidly establishes, between the electrodes of the plug, a high voltage which can be adjusted to cause a disruptive discharge in the air-fuel mixture, suitable for ensuring the ignition of this mixture.

As shown in FIG. 1, the AC voltage at the resonant frequency then delivered by the oscillator 11, supplies the primary winding $7_P$ of the transformer 7 through a gate 15 and a cylinder selector 16, both controlled by a duly programmed computer 17.

On the waveform of FIG. 2 the priming phase of the arc corresponds to the time interval (O, $t_o$) during which the voltage $U_B$ at the terminals of the plug increases with each alternation, the latter occurring at the resonant frequency Fo of the circuit (Lf, Cs) given by the formula:

$$Fo = \frac{1}{2\pi\sqrt{Lf \cdot Cs}}$$

where

Lf=inductance of the resonant circuit

Cs=capacitance of the resonant circuit

With output voltages of the converter of the order of + or −200 V, a transformation ratio of the transformer 9 of the order of only 10 and a resonant frequency of 300 kHz for example, the priming voltage $U_{B}o$ of the plug, which can vary from 7 to 30 kV for example, is attained in a few microseconds for an interelectrode gap of the order of 0.6 mm, as a function, in particular, of the composition of the air-fuel mixture to be ignited, its pressure, its temperature, etc.

The self inductance Lf can be partly or entirely constituted by the overall leakage inductance of the transformer 9, seen from the side of the secondary. This is the reason why the self inductance Lf has been shown from the side of the secondary, whereas in fact this self inductance is distributed in both windings of the transformer 9. Similarly the capacitance Cs can be constituted by the parallel grouping of the inherent capacitance of the secondary winding $9_S$ and the capacitance of the plug. These intrinsic inductances and capacitances could be modified by the branch connection of an additional self inductance and/or capacitor under the assumption that it would be desired to adjust the resonant frequency of the circuit to a value other than that determined by the intrinsic capacitance and inductance of the resonant circuit which are present in the assembly formed by the transformer 9 and the plug 10.

The synchronization of the oscillator 11 on the resonant frequency of this circuit is clearly an essential step for the operation of the device according to the invention, which step will now be described in detail.

This step intervenes right at the start of an ignition sequence (during the first halfwave of the voltage $U_B$, see FIG. 2) at the triggering of such a sequence by the computer 17 which controls, via a line 18, a gate 15 and, via a line 18', the mode selector 13 to connect the output of the oscillator 11 to the primary $7_P$ of the transformer 7, the output of the oscillator 11 being temporarily forced to a stable electrical voltage level by means of the mode selector 13 which makes it possible, by the application of this voltage step, to obtain the "resonant frequency Fo search" mode during priming. The computer simultaneously sends another signal to the cylinder selector 16 to connect the output of the selector to the transformer 7 of an ignition circuit of a predetermined plug chosen from the four plugs which equip a four cylinder engine for example.

The current response of the resonant circuit (Lf, Cs) to the voltage step present on the output of the oscillator 11 is taken, via a line 22, from the resistor 14 and is representative, in frequency and in phase, of the resonant conditions of the circuit (Lf, Cs). A servocontrol circuit (not shown) internal to the mode selector 13 is then sensitive to the zero crossing of the first halfwave of the return current in the resistor 14 following the application of the voltage step, so as to determine the resonant frequency of the circuit (Lf, Cs) and synchronize the output of the oscillator on this frequency.

After this step of searching for the resonant frequency, the mode selector 13, having measured the frequency Fo, regulates the output frequency of the oscillator 11 on this frequency, the output of the oscillator being connected to the primary of the transformer 7 through the cylinder selector 16 and the gate 15. The primary winding $7_P$ of the transformer 7 then orders the transistors 5 and 6 to the resonant frequency and the line 8 then supplies the transformer 9 and the resonant circuit (Lf, Cs) at this same frequency.

In FIG. 4 the curve of voltage amplification by resonance has been represented as a function of the frequency during priming. This curve displays a maximum which is a function of the capacitance Cs, of the inductance Lf and the parameters connected with the characteristics of the interelectrode gap of the plug. According to the present invention, by adjusting the frequency to the location of this maximum, that is to say to the resonant frequency Fo of the circuit Lf, Cs, the benefit is obtained of a voltage amplification effect and the ignition voltage of the arc can be attained in a few microseconds.

At the instant when this ignition is obtained the power transmitted to the coil falls sharply and this fall is perceived by the mode selector 13, with the aid of the current in the resistor 14 detected via the line 22. The selector 13 then flips so as to establish the second control strategy for the oscillator, which strategy is used to ensure, according to an important characteristic of the present invention, the sustaining of the arc in the plug for a period controlled by the computer 17 (see FIG. 2, after the instant $t_o$). As was seen in the introduction to the present description, in the conventional ignition devices it is not possible to act on the sustaining period of the arc and so the energy delivered to the plug cannot be controlled. This absence of control can prove to be damaging, in particular when the engine turns at low speed, a circumstance in which a speed instability of the engine can be observed.

According to the invention to sustain the arc in the sustaining phase an arc-sustaining power, which can be tuned to a level different to that necessary for the ignition of the arc, is transmitted to the plug.

In fact if, commonly, for the ignition of an air-fuel mixture in an internal combustion engine with the help of a conventional plug it is necessary to develop between the electrodes of the plug a high voltage lying between 70 and 30 kV approximately, as soon as the arc thus obtained is primed the voltage between the electrodes of the plug falls in the region 100 V−2 kV approximately, because of the presence of a conducting plasma between the electrodes.

In FIG. 3 the typical behaviour of the power transmitted to the plug through a transformer has been shown as a function of the frequency of the supply, in the sustaining phase of an arc in the plug.

For sustaining the arc a power level Pe corresponding to a frequency Fe has been determined. The mode selector 13 then comprises means sensitive to the difference between this frequency Fe and the frequency Fo at which the oscillator 11 operates at the moment of the triggering of the arc, for correcting the operating frequency of the oscillator so as to bring the frequency to the frequency Fe suitable for ensuring sustaining of the arc.

This arc being thus sustained the computer 17 can tune the period thereof, as a function of the speed of the engine for example, by cutting, after the elapsing of this period, the connection established by the gate 15 between the output of the oscillator 11 and the transformer 7 through the cylinder selector 16.

The ignition device according to the invention thus constituted offers numerous highly desirable advantages, as has been seen earlier.

On the one hand, by virtue of the resonance phenomenon employed in the invention, the transformer interposed between the AC voltage source and the plug no longer being used to store energy but only to transmit it, it is possible to endow it with a small space requirement such that it may be individually combined onto each of the plugs of an internal combustion engine, a solution which enables the elimination of the distributor and of the long cables for transferring a high voltage to these plugs, results which currently are highly sought after. Thus, it is possible to provide for a mechanical coupling between the transformer 9 and the plug 10.

On the other hand, by monitoring the power dissipated in the plug with the help of that drawn in the primary of the transformer, it is possible to regulate the oscillator to a frequency ensuring the sustaining of the arc after its priming for a period which can be adjusted as a function of various operating parameters of the engine, in particular its speed, to avoid ignition instabilities, in particular at low speed. Similarly it is possible to detect an accidental extinction of the arc so as to order in reply a repriming of the latter.

Of course the invention is not limited to the embodiment described and represented, which has been given only by way of example. In particular, the AC voltage source could take numerous known forms other than that used in the invention where this source comprises a DC—DC step up converter and a pair of electronic switches controlled in phase opposition at a frequency adjusted by a voltage controlled oscillator.

Similarly the signal representing the energy transmitted to the plug can be taken elsewhere than from an impedence placed at the foot of the primary winding of the transformer 9. At this location the signal taken may not be entirely representative of the energy transmitted to the plug by reason of reactive components due, inter alia, to the transformer 9. It would be possible to escape from this reactive energy by taking the signal from an output 23 (see FIG. 1) specifically provided for this purpose in the converter 2, so as to obtain a picture of only the active power delivered to the plug.

As a variant, the device according to the invention could comprise only a single voltage source (1, 2, 7, 5, 6), the output of the gate 15 being connected directly to the transformer 7, the line 8 supplying each of the transformers 9, the cylinder selector 16 then being used to ensure, through other means, the selection of the desired transformer, a solution which allows duplication of only the transformer 9.

It will be further noted that the resonant ignition according to the invention can be adapted to an ignition device comprising a distributor in the conventional manner. There is then no longer any reason to duplicate the transformer 9. Thus, such a device profits from the volume reduction of the transformer and from the possibility for tuning the period of the electric arc, which are ensured by the implementation of the present invention.

We claim:

1. In an internal combustion engine with a spark plug having electrodes between which an arc is formed for igniting an air-fuel mixture in a cylinder, an engine ignition device comprising:

means for providing direct current voltages;

a first transformer having a primary winding and a secondary circuit having first and second secondary windings wound in mutual phase-opposition forming a first transformer secondary circuit output;

said first transformer secondary circuit output including two electronic switches respectively connected in series between said voltages from said direct current voltage means, each switch being controlled by a respective one of said first and second secondary circuits of said first transformer;

a high voltage generator for selectively supplying the spark plug for triggering an ignition arc, said high voltage generator including a resonant circuit supplied by said first transformer secondary circuit output at a resonant frequency of said resonant circuit for supplying the spark plug with a resonance-amplified voltage suitable for causing an ignition arc between the electrodes of the spark plug;

said high voltage generator further including a second transformer having primary and secondary circuits and being connected between said first transformer and the spark plug;

said resonant circuit being connected between said second transformer and the spark plug and being formed by a series inductance in said secondary circuit of said second transformer and a parallel capacitance on the spark plug;

measuring means for detecting a current in said primary circuit of said second transformer; and an oscillator for supplying said primary circuit of said first transformer the frequency of said oscillator being controlled according to the detected current in said primary winding of said second transformer.

2. The ignition device according to claim 1, wherein said second transformer has a leakage inductance as seen from said secondary circuit and said inductance of said resonance circuit is at least partly formed by the leakage inductance.

3. The ignition device according to claim 1, wherein the spark plug and said secondary circuit of said second transformer have a capacitance and wherein said capacitance of said resonant circuit is at least partly formed by a parallel connection of the capacitances of the spark plug and said secondary winding of said second transformer.

4. The ignition device according to claim 1, including a mode selector for controlling said oscillator during one of priming the arc and sustaining the arc of the spark plug.

5. The ignition device according to claim 1, including means for forcing the output of the oscillator to a stable voltage level for applying a voltage step to said primary winding of said first transformer at the start of an arc priming phase, and means for measuring a behavior of said resonant circuit in response to the application of the voltage step, said mode selector including means being responsive to said measuring means for subsequently tuning the frequency of said oscillator to the resonant frequency of said circuit.

6. The ignition device according to claim 4, wherein priming the arc in the spark plug is a first control strategy and sustaining the arc is a second control strategy for said oscillator, wherein said mode selector is responsive to said first control strategy in the spark plug for subsequently establishing said second control strategy for said oscillator in which an output frequency of said oscillator is tuned to a value corresponding to a transfer of a desired power into the spark plug for sustaining the arc.

7. The ignition device according to claim 5, wherein said measuring means include means for detecting a current in said primary circuit of said second transformer, and means for providing, during sustaining of the arc, a signal representing an electrical power transmitted to said resonant circuit.

8. The ignition device according to claim 1, wherein said means for providing direct voltages are in the form of a DC—DC converter being supplied by a battery, said converter including an output for supplying said mode selector with a signal representing a power transmitted to said resonant circuit for adjusting a frequency of a signal delivered by said oscillator during a sustaining phase of the arc.

9. The ignition device according to claim 1, including computer means for determining an instant of ignition and a duration for the arc, and a gate and a cylinder selector connected in series and controlled by said computer means for selectively connecting an output of said oscillator to said primary winding of said first transformer at a predetermined instant and for a predetermined period of time.

10. The ignition device according to claim 1, wherein the internal combustion engine is a multi-cylinder engine with a plurality of spark plugs, and said second transformer is a plurality of second transformers each being associated with a respective spark plug.

11. The ignition device according to claim 10, wherein said AC voltage source is in the form of a plurality of voltage sources each being associated with a respective one of said second transformers.

12. The ignition device according to claim 1, wherein the internal combustion engine is a multi-cylinder engine with a plurality of spark plugs, and including a distributor for successively and sequentially connecting a respective one of the spark plugs to said second transformer.

* * * * *

UNITED STATES PATENT AND TRADEMARK OFFICE

CERTIFICATE OF CORRECTION

PATENT NO. : 5,179,928

DATED : January 19, 1993

INVENTOR(S) : Maurice H.M. Cour, Francois J.R. Vernieres

It is certified that error appears in the above-indentified patent and that said Letters Patent is hereby corrected as shown below:

On the Title page, item (75), change "Marie M.H. Cour," to --Maurice H.M. Cour--; and "Raymond F.J. Vernieres" to --Francois J.R. Vernieres--.

Signed and Sealed this

Second Day of November, 1993

*Attest:*

*Attesting Officer*

BRUCE LEHMAN

*Commissioner of Patents and Trademarks*